US005164773A

United States Patent [19]

Nishio et al.

[11] Patent Number: 5,164,773

[45] Date of Patent: Nov. 17, 1992

[54] DEVELOPING DEVICE USED IN ELECTROPHOTOGRAPHIC FIELD

[75] Inventors: Yukio Nishio, Tama; Hiroshi Kera, Fukushima; Yoshihiro Tonomoto, Yokohama; Kazunori Hirose, Hiratsuka, all of Japan

[73] Assignee: Fujitsu Limited, Kawasaki, Japan

[21] Appl. No.: 540,728

[22] Filed: Jun. 20, 1990

[30] Foreign Application Priority Data

Jun. 21, 1989 [JP] Japan ..... 1-159319
Jun. 29, 1989 [JP] Japan ..... 1-167642

[51] Int. Cl.[5] ..... G03G 15/06

[52] U.S. Cl. ..... 355/245; 355/246; 355/261; 355/264; 355/265

[58] Field of Search ..... 355/245, 264, 265, 270, 355/261, 251, 253, 298, 299, 246, 204, 208, 200; 118/653, 661, 651

[56] References Cited

U.S. PATENT DOCUMENTS

| | | | |
|---|---|---|---|
| 4,286,543 | 9/1981 | Ohnuma et al. | 118/657 |
| 4,743,937 | 5/1988 | Martin | 355/259 |
| 4,745,429 | 5/1988 | Mukai et al. | 355/259 X |
| 4,755,847 | 7/1988 | Matsushiro et al. . | |
| 4,760,422 | 7/1988 | Seimiya et al. | 355/253 |
| 4,788,570 | 11/1988 | Ogata et al. | 355/245 |
| 4,791,882 | 12/1988 | Enoguchi et al. | 118/653 |
| 4,893,151 | 1/1990 | Yamazaki et al. | 355/245 |
| 4,930,438 | 6/1990 | Demizu et al. | 118/651 |
| 4,967,231 | 10/1990 | Hosoya et al. | 355/259 X |
| 5,062,385 | 11/1991 | Nishio et al. | 118/653 |
| 5,068,691 | 11/1991 | Nishio et al. | 118/653 X |
| 5,076,201 | 12/1991 | Nishio et al. | 118/653 |

FOREIGN PATENT DOCUMENTS

| | | | |
|---|---|---|---|
| 53-138349 | 12/1978 | Japan . | |
| 54-137346 | 10/1979 | Japan . | |
| 55-77764 | 6/1980 | Japan . | |
| 57-120947 | 7/1982 | Japan . | |
| 60-6846 | 3/1985 | Japan . | |
| 60-12627 | 4/1985 | Japan . | |
| 61-43767 | 3/1986 | Japan . | |
| 62-976 | 1/1987 | Japan . | |
| 0067569 | 3/1987 | Japan | 355/261 |
| 0095558 | 5/1987 | Japan | 355/261 |
| 62-96981 | 5/1987 | Japan . | |
| 62-118372 | 5/1987 | Japan . | |
| 0044678 | 2/1988 | Japan | 355/253 |
| 63-100482 | 5/1988 | Japan . | |
| 0103280 | 5/1988 | Japan | 355/251 |
| 63-189876 | 8/1988 | Japan . | |
| 63-231469 | 9/1988 | Japan . | |
| 0269180 | 11/1988 | Japan | 355/253 |
| 2163371A | 2/1986 | United Kingdom . | |

*Primary Examiner*—A. T. Grimley
*Assistant Examiner*—Matthew S. Smith
*Attorney, Agent, or Firm*—Armstrong & Kubovcik

[57] ABSTRACT

A developing device using a one-component developer composed of toner particles includes a developing roller rotatably provided within the vessel, a portion of the developing roller being exposed therefrom and resiliently pressed against a surface of a photosensitive drum. The toner particles are entrained by the roller surface to form a developer layer therearound and are carried to the drum surface for the development of an electrostatic latent image formed thereon, and a blade member is engaged with the roller for regulating a thickness of the developer layer. A voltage is supplied to the roller to electrostatically move the toner particles from the roller to the latent image, and a voltage is applied to the blade member to inject an electrical charge to the developer layer. When an operation of the device is started, a supply of the voltages to the roller and blade member is carried out after the roller is rotated. When the operation is interrupted or stopped, the supply of the voltage to the blade member is prematurely stopped before the supply of the voltage to the roller and the rotation thereof are stopped.

26 Claims, 7 Drawing Sheets

POWER ON/OFF CONTROL ROUTINE
201
F1 = "0" ?
NO
YES
202
READY FOR IMAGE DATA WRITING ?
NO
YES
203
DRIVE CIRCUIT 31 ON
204
1 + C1 ← C1
205
C1 ≧ 250 ?
NO
YES
206
POWER SOURCE 19 ON
207
POWER SOURCE 23 ON
212
IMAGE DATA WRITING COMPLETE ?
NO
YES
213
F2 = "0" ?
NO
YES
214
1 + C2 ← C2
215
C2 ≧ 125 ?
NO
YES
216
POWER SOURCE 23 OFF
217
1 ← F2

DEVELOPING DEVICE USED IN ELECTROPHOTOGRAPHIC FIELD

BACKGROUND OF THE INVENTION

1. Field of the Invention

The present invention relates to a developing device used in an electrophotographic field, wherein an electrostatic latent image is visually developed by using a one-component developer, particularly a non-magnetic type one-component developer.

2) Description of the Related Art

As is well known, an electrophotographic printer carriers out the processes of: producing a uniform distribution of electrical charges on a surface of an electrostatic latent image carrying body such as an electrophotographic photoreceptor; forming an electrostatic latent image on the electrically charged surface of the electrophotographic photoreceptor by optically writing an image thereon, using a laser beam scanner, an LED (light emitting diode) array, an LCS (liquid crystal shutter) array or the like; visually developing the electrostatic latent image with a developer, i.e., toner, which is electrically charged to be electrostatically adhered to the electrostatic latent image zone; electrostatically transferring the developed visible image to a paper; and fixing the transferred image on the paper. Typically, the electrophotographic photoreceptor is formed as a photosensitive drum having a cylindrical conductive substrate and a photoconductive insulating film bonded to a cylindrical surface thereof.

In the developing process, a two-component developer composed of a toner component (colored fine synthetic resin particles) and a magnetic component (magnetic fine carriers) is widely used, as it enables a stable development of the latent image. Note, typically the toner particles have an average diameter of about 10 μm. and the magnetic fine carriers have a diameter ten times larger than the average diameter of the toner particles. Usually, a developing device using the two-component developer includes a vessel for holding the two-component developer, wherein the developer is agitated by an agitator provided therein. This agitation causes the toner particles and the magnetic carriers to be subjected to tribeoelectrification, whereby the toner particles are electrostatically adhered to each of the magnetic carriers. The developing device also includes magnetic roller, provided in the vessel as a developing roller, in such a manner that a portion of the magnetic roller is exposed therefrom and faces the surface of the photosensitive drum. The magnetic carriers with the toner particles are magnetically adhered to the surface of the magnetic roller to form a magnetic brush therearound, and by rotating the magnetic roller carrying the magnetic brush, the toner particles are brought to the surface of the photosensitive drum for the development of the electrostatic latent image formed thereon.

In this developing device, a ratio between the toner and magnetic components of the developer body held in the vessel must fall within a predetermined range, to continuously maintain a stable development process. Accordingly, the developing device is provided with a toner supplier from which a toner component is supplied to the two-component developer held in the vessel, to supplement the toner component as it is consumed during the development process, whereby the component ratio of the two-component developer held by the vessel is kept within the predetermined range.

This use of a two-component developer is advantageous in that a stable development process is obtained thereby, but the developing device per se has the disadvantages of a cumbersome control of a suitable component ratio of the two-component developer, and an inability to reduce the size of the developing device due to the need to incorporate the toner supplier therein.

A one-component developer is also known in this field, and a developing device using same does not suffer from the above-mentioned disadvantages of the developing device using the two-component developer, because the one-component developer is composed of only a toner component (colored fine synthetic resin particles). Two types of the one-component developer are known; a magnetic type and a non-magnetic type. A developing device using the magnetic type one-component developer can be constructed in substantially the same manner as that using the two-component developer. Namely, the magnetic type one-component developer also can be brought to the surface of the photosensitive drum by a rotating magnetic roller as in the developing device using the two-component developer. The magnetic type one-component developer is suitable for achromatic color (black) printing, but is not suitable for chromatic color printing. This is because each of the toner particles composing the magnetic type one-component developer includes fine magnetic powders having a dark color. In particular, the chromatic color printing obtained from the magnetic type one-component developer appears dark and dull, due to the fine magnetic powders included therein. Conversely, the non-magnetic type one-component developer is particularly suitable for chromatic color printing because it does not include a substance having a dark color, but the non-magnetic type one-component developer cannot be brought to the surface of the photosensitive drum by the magnetic roller as mentioned above.

A developing device using the non-magnetic type one-component developer is also known, as disclosed in U.S. Pat. Nos. 3,152,012 and No. 3,754,963, Japanese Examined Patent Publication (Kokoku) No. 60-12627, and Japanese Unexamined Patent Publications (Kokai) No. 62-976, No. 62-118372, No. 63-100482, and No. 63-189876. These developing devices include a vessel for holding the non-magnetic type and-component developer, and a conductive elastic roller provided within the vessel as a developing roller in such a manner that a portion of the elastic roller is exposed therefrom and can be pressed against the surface of the photosensitive drum. The conductive elastic developing roller may be formed of a conductive silicone rubber material or a conductive polyurethane rubber material or the like. When the conductive rubber roller is rotated within the body of the non-magnetic type one-component developer held by the vessel, the toner particles composing the non-magnetic type one-component developer are frictionally entrained by the surface of the conductive rubber developing roller to form a developer layer therearound, whereby the toner particles can be brought to the surface of the photosensitive drum for the development of the electrostatic latent image formed thereon. In this developing device, the development process is carried out in such a manner that, at the area of contact between the photosensitive drum and the conductive rubber developing roller carrying the developer layer, the charged toner particles are electrostatically attracted and adhered to the latent image due to a bias voltage supplied to the conductive solid rubber developing roller.

The developing device further includes a blade member which is resiliently pressed against the surface of the developing roller, to uniformly regulate a thickness of the developer layer formed therearound so that an even development of the latent image can be carried out. The blade member may be also used to electrically charge the toner particles by a triboelectrification therebetween and/or by a charge-injection effect resulting from supply of voltage to the conductive blade member. Of course, when the charge-injection effect is utilized, the blade member is formed of a conductor such as a conductive rubber material, aluminum, stainless steel, brass or the like.

The supply of voltage to the blade member also serves to prevent an electrostatical adhesive of the toner particles to the blade member during the regulation of a thickness of the developer layer formed around the developing roller.

The developing device may be also provided with a toner-developing roller which is rotated in contact with the developing roller so that remaining toner particles not used for the development of the latent image are mechanically removed from the developing roller, whereby a fresh developer layer can be continuously formed on the surface of the developing roller. Note, the developer layer formed of the remaining toner particles not used for the development of the latent image should be once removed from the developing roller because it is subjected to physical and electrical affects during the developing process, and thus prevents a physical and electrical even formation of the developer layer around the developing roller. The toner-removing roller is frequently formed of a conductive porous rubber material, so that the remaining toner particles not used during the development of the latent image can be also electrostatically removed from the developing roller. In particular, a voltage is supplied to the conductive toner-removing roller so that the charge toner particles are electrostatically attracted from the developing roller to the toner-removing roller, whereby not only the mechanical removal of the remaining toner particles but also the electrostatic removal thereof can be carried out.

Conventionally, when a drive motor is driven for the rotation of the developing roller, the voltages are simultaneously supplied to the developing roller, the blade member, and the toner-removing roller, respectively. Nevertheless, the rotation of the developing roller cannot be started at exactly the same time as voltages are supplied to the developing roller, the blade member, and the toner-removing roller, due to a backlash of a gear train provided between the drive motor and the developing roller. Namely, before the rotation of the developing roller is started, the voltages are supplied to the developing roller, the blade member, and the toner-removing roller, and thus a high electrical current flows at localized contacting zones between the developing roller and the blade member and toner-removing roller, resulting in a fusion of the developing roller at the localized contacting zones due to the generation of Joule heat. Of course, when the surface of the developing roller is damaged, the quality of a developed image( and thus a printed image) is deteriorated.

Also, conventionally, when the developing device is in a non-operative condition, the developer layer formed around the developing roller is left as it is. Accordingly, the toner particles existing between the photosensitive drum and the developing roller may be adhered not only to each other but also to the surface of the photosensitive drum, because the developing roller is resiliently pressed against the photosensitive drum, and thus when the developing device is again operated the quality of a printed image is deteriorated.

SUMMARY OF THE INVENTION

Therefore, an object of the present invention is to provide a developing device as mentioned above, which is constituted such that the voltages are supplied to the blade member and toner-removing roller after the rotation of the developing roller, whereby a high electrical current cannot flow at localized contacting zones between the developing roller and the blade member and toner-removing roller.

Another object of the present invention is to provide a developing device as mentioned above, which is constituted such that the developer layer formed around the developing roller is at least partially removed from the developing roller just before an operation of the developing device is interrupted or stopped, so that the toner particles do not remain between the photosensitive drum and the developing roller.

In accordance with the present invention, there is provided a developing device using a one-component developer composed of toner particles, which device comprises a vessel for holding the developer, and a developing roller rotatably provided within and supported by the vessel in such a manner that a portion of the developing roller is exposed therefrom. The exposed portion of the developing roller is pressed against a surface of an electrostatic latent image carrying body, and the developing roller is formed of a conductive elastic material by which the toner particles are entrained to form a developer layer therearound and are carried to the surface of the electrostatic latent image carrying body for development of an electrostatic latent image formed thereon. The developing roller is rotated by a drive motor which is driven by a motor drive circuit. A blade member is provided within the vessel and is pressed against the developing roller for regulating a thickness of the developer layer formed therearound. A developing bias voltage is supplied from a first power source to the developing roller, and a voltage is supplied from a second power source to the blade member to inject an electric charge to the toner particles of the developer layer and/or to prevent an electrostatic adhesion of the toner particles to the blade member. According to the present invention, when the developing device is operated, the first and second power sources and the motor drive circuit are controlled in such a manner that the supply of the voltages to the developing roller and the blade member is carried out after the developing roller is rotated by the drive motor. On the other hand, when the operation of the developing device is interrupted or stopped, the first and second power sources and the motor drive circuit are controlled in such a manner that the supply of the voltage to the blade member is prematurely stopped before the supply of the voltage to the developing roller and the rotation of the developing roller are stopped.

The developing device may comprise a toner-removing roller rotatably provided within and supported by the vessel in such a manner that it is resiliently pressed against the developing roller, the toner-removing roller being formed of a conductive elastic material and being rotated so that remaining toner particles not used for the development of the latent image are mechanically removed from the developing roller, and a third power source for supplying a voltage to the toner-removing roller to electrostatically remove the remaining toner particles from the developing roller. In this case, when the developing device is operated, the first, second, and third power sources and the motor drive circuit are controlled in such a manner that the supply of the voltages to the developing roller, blade member, and toner-removing roller is carried out after the developing roller is rotated by the drive motor. When the operation of the developing device is interrupted or stopped, the first, second, and third power sources and the motor drive circuit are controlled in such a manner that the supply of the voltage to the blade member is prematurely stopped before the supply of the voltages to the developing roller and toner-removing roller and the rotation of the developing roller are stopped.

The second power source for the blade member may be constituted so that one of first and second voltages is selectively supplied to the blade member, the first voltage having a polarity opposite to that of the second voltage. The first voltage is supplied to the blade member to inject an electric charge to the toner particles of the developer layer and/or to prevent an electrostatic adhesion of the toner particles to the blade member during the development of the latent image, the second voltage is supplied to the blade member to electrostatically remove the toner particles of the developer layer from the developing roller after the development of the latent image is completed. In this case, when the developing device is operated, the first and second power sources and the motor drive circuit are controlled in such a manner that a change of the supply of the first voltage to the supply of the second voltage is carried out before the supply of the voltage to the developing roller and the rotation of the developing roller are stopped. When the operation of the developing device is interrupted or stopped, the first and second power sources and the motor drive circuit are controlled in such a manner that a change of the supply of the first voltage to the supply of the second voltage is carried out before the supply of the voltage to the developing roller and the rotation of the developing roller are stopped.

Preferably, the developing roller is formed of a conductive open-cell foam material so that pore openings are formed over a surface of the developing roller, the pore opening shaving a diameter which is at most twice an average diameter of the toner particles. The conductive open-cell foam material of the developing roller may be selected from the group consisting of a conductive polyurethane open-cell foam rubber material, a conductive silicone foam rubber material, and a conductive acrylonitorile-butadiene open-cell foam rubber material. Also, the toner-removing roller is preferably formed of a conductive open-cell foam rubber material.

BRIEF DESCRIPTION OF THE DRAWINGS

The objects and advantages of the present invention will be better understood from the following description, with reference to the accompanying drawings, in which.

DESCRIPTION OF THE PREFERRED EMBODIMENTS

Figure 1:
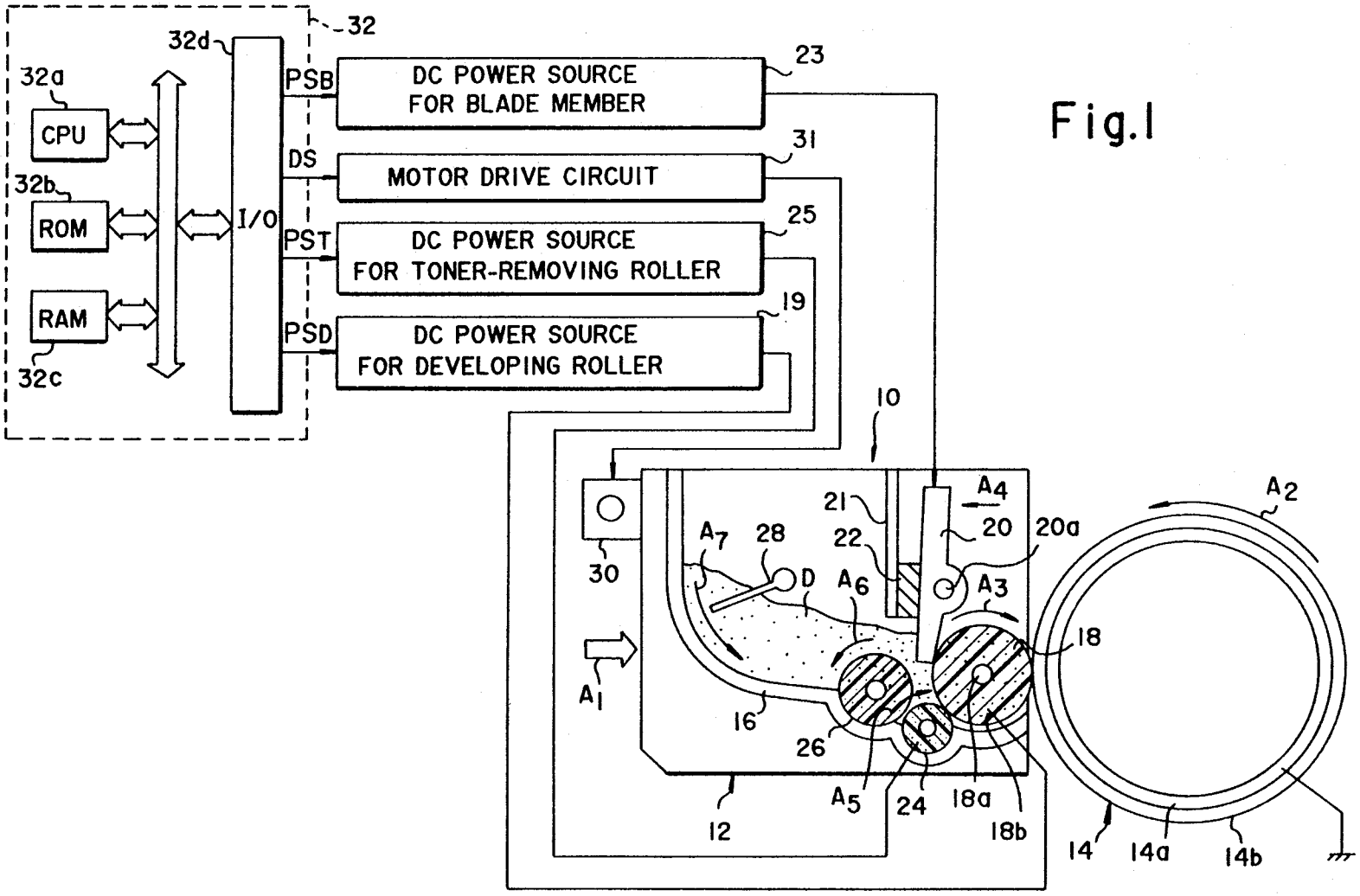
FIG. 1 is a schematic diagram of an embodiment of a developing device according to the present invention.

FIG. 1 is a schematic diagram of a developing device 10 using a non-magnetic type one-component developer and incorporated into an electrophotgraphic printer (not shown). The developing device 10 comprises a casing 12 supported by a frame structure of the electrophotograhic printing machine in such a manner that the casing 12 is movable toward and away from a photosensitive drum 14 forming a part o the electrophotgraphic printer. The photosensitive drum 14 comprises a sleeve substrate 14*a* made of a conductive material such as aluminum, and a photoconductive material film 14*b* formed theraround. The photoconductive material film 14*b* of the photosensitive drum 14 may be composed of an organic photoconductor (OPC), a selenium photoconductor or the like. A uniform distribution of electrical charges is produced on a surface of the photoconductive material film 14*b* of the photosensitive drum 14 by a suitable charger (not shown), such as a corona discharger, and an electrostatic latent image is them optionally written on the charged surface of the photoconductive material film 14*b* by an optical writing means (not shown) such as a laser beam scanner, an LED (light emitting diode) array, a liquid crystal shutter array or the like. In particular, when the charged area of the photoconductive material film 14*b* is illuminated by the optical writing means, the charges are released from the illuminated zone through the grounded sleeve substrate 14*a*, so that a potential difference between the illuminated zone and the remaining zone forms the electrostatic latent image.

The casing 12 includes a vessel 16 for holding a non-magnetic type one-component developer D composed of colored fine toner particles of a suitable synthetic resin such as polyester or styrene acrylic resin, and having an average diameter of about 10 $\mu$m.

The developing device 10 also comprises a conductive developing roller 18 rotatably provided within the vessel 16, a portion of which is exposed therefrom. The casing 12 is resiliently biased in a direction indicated by an arrow $A_1$, by a suitable resilient element (not shown) such as a coil or leaf spring, so that the exposed portion of the developing roller 18 is resiliently pressed against the surface of the photosensitive drum 14. During an operation of the developing device, the photosensitive drum 14 and the developing roller 18 are rotated in the directions indicated by arrows $A_2$ and $A_3$, and the developing roller 18 entrains the toner particles to form a developer layer therearound, whereby the toner particles are brought to the surface of the photosensitive drum 14 for the development of the latent image formed thereon. For example, the photosensitive drum 14 may have a diameter of 60 mm and a peripheral speed of 70 mm/s. Further, the developing roller 18 may have a diameter of 20 mm and a peripheral speed of from 1 to 4 times that of the photosensitive drum 14.

The developing roller 18 comprises a shaft 18*a* rotatably supported by the walls of the vessel 16, and a roller element 18*b* mounted thereon. The roller element 18*b* may be preferably formed of a conductive open-cell foam elastic material such as a conductive open-cell foam polyurethane rubber material, a conductive open-cell foam silicone rubber material, or a conductive open-cell foam acrylonitrile-butadiene rubber material. This is because an elasticity or hardness of the roller element 18*b* is an important parameter for a proper development of the latent image by the developing rubber roller 18. In particular, the development quality and the development toner density are greatly affected by a contact or nip width between the photosensitive drum 14 and the developing roller 18 pressed thereagaint, and thus the developing roller 18 must be pressed against the photosensitive drum 14 so that a given nip width by which a proper development is obtained is established therebetween. If the roller element 18*b* is formed as a conductive solid rubber roller, it may have a relatively high hardness. For example, when measured by an Asker C-type hardness meter, the solid rubber developing roller showed an Asker C-hardness of about 58°. Accordingly, the solid rubber developing roller must be pressed against the photosensitive drum 14 with a relatively high pressure to obtain the required nip width therebetween; but the higher the pressure exerted upon the photosensitive drum 14 by the solid rubber developing roller, the greater the premature wear of the photosensitive drum 14.

Furthermore, the developing roller 18 is preferably constituted in such a manner that pore openings in the conductive open-cell foam rubber roller element 18*b* have a diameter which is at most twice the average diameter of the toner particles, whereby a penetration of the toner particles into the porous rubber roller element 18*b* can be prevented. This is because, for example, when the two toner particles having the 10 μm diameter are captured by the pore opening having the 20 μm diameter, these toner particles interfere with each other in such a manner they are prevented from penetrating into the open-cell foam structure of the roller element 18*b*. Namely, when the pore openings in the conductive open-cell foam rubber roller element 18*b* have a diameter which is at most twice the average diameter of the toner particles, a softness of the roller element 18*b* can be maintained since it is not hardened by the penetration of the toner particles therein, whereby a long operating life of the developing roller can be ensured and a proper development process can be maintained.

The conductive open-cell foam rubber roller element 18*b* preferably has a volume resistivity of about $10^4$ to $10^{10}\Omega\cdot$m, most preferably $10^6\Omega\cdot$m, and an Asker-C hardness of about 10° to 50°, most preferably 10°. The developing roller 18 may be pressed against the photosensitive drum 14 at a linear pressure of about 20 to 50 g/cm, most preferably 43 g/cm, so that a contact or nip width of about 1 to 3.5 mm can be obtained between the developing roller 18 and the photosensitive drum 14. Note, the nip width of about 1 to 3.5 mm is necessary to achieve the proper development of the latent image. As shown in FIG. 1, the developing roller 18 is connected to a DC power source 19 by which a developing bias voltage is supplied thereto.

The developing device 10 further comprises a blade member 20 engaged with the surface of the developing roller 18 to uniformalize a thickness of the developer layer formed therearound, whereby an even development of the latent image is ensured. The blade member 20 is pivotably mounted on a pivot pin 20*a* supported by vessel 16, and is resiliently biased in a direction indicated by an arrow $A_4$ so that the blade member 20 is resiliently pressed against the developing roller 18 at a linear pressure of about 26 g/mm, to regulate the thickness of the developer layer formed therearound. The vessel 16 is provided with a partition 21 disposed therein adjacent to the blade member 20, and a stopper member 22 made of a foam rubber material or sponge material is disposed between the partition 21 and the blade member 20, so that the developer D is prevented from entering a space therebetween. The blade member 20 may be formed of a conductive rubber material, but preferably is coated with TEFLON, and may be further formed of a suitable metal material such as aluminum, stainless steel, brass or the like. As shown in FIG. 1, the blade member 20 is connected to a DC power source 23 by which a voltage is supplied thereto so that an electric charge is injected to the toner particles of the developer layer formed around the developing roller 18, and by which an electrostatic adhesion of the toner particles to the blade member 20 is prevented during the regulation of a thickness of the developer layer formed around the developing roller 18.

The developing device 10 further comprises a toner-removing roller 24 rotatably provided within the vessel 16 and in contact with the developing roller 18 in such a manner that a contact or nip width of about 1 mm is obtained therebetween, and by which remaining toner particles not used for the development of the latent image are removed from the developing roller 18.

The toner-removing roller 24 is formed of a conductive open-cell foam rubber material, preferably a conductive open-cell foam polyurethane rubber material having a volume resistivity of about $10^6\Omega\cdot$m, and an Asker-C hardness of about 10° to 70°, most preferably 30°. The toner-removing roller 24 is rotated in the same direction as the developing roller 18, as indicated by an arrow $A_5$, whereby the remaining toner particles are mechanically removed from the developing roller 18. For example, the toner-removing roller 24 may have a diameter of 11 mm and a peripheral speed of from 0.5 to 2 times that of the developing roller 18. As shown in FIG. 1, the toner-removing roller 24 is connected to a DC power source 25 by which a voltage is supplied thereto so that the remaining toner particles also can be electrostatically removed from the developing roller 18. Note, the toner-removing roller 24 is partially received in a recess formed in a bottom portion of the vessel 16, whereby a leakage of the toner particles from a space between the developing roller 18 and the vessel bottom can be prevented.

Furthermore, the developing device 10 comprises a paddle roller 26 for moving the toner particles toward the developing roller 18, and an agitator 28 for agitating the developer D to eliminate a dead stock thereof from the vessel 16. The paddle roller 26 and the agitator 28 are rotated in the directions indicated by arrows $A_6$ and $A_7$. The developing device 10 is also provided with a drive motor 30 mounted on the casing 12, by which the developing roller 10, the toner-removing roller 24, the paddle roller 26, and the agitator 28 are driven through the intermediary of a gear train (not shown). The drive motor 30 is connected to a motor drive circuit 31 by which the motor 30 is driven.

FIG. 1 also shows a control circuit 32 of the electrophotographic printer into which the developing device 10 is incorporated, and by which an ON/OFF control of the DC power sources 19, 23, and 25 and the motor drive circuit 31 is carried out. Note, as is obvious, the control circuit 32 also commands the overall operation of the electrophotgraphic printer. As illustrated, the control circuit 32 may be constructed by a microcomputer which comprises a central processing unit (CPU) 32*a*, a read-only memory (ROM) 32*b* for storing routines, constants, etc., a random access memory (RAM) 32*c* for storing temporary data, and an input/output interface (I/O) 32*d*.

Figures 2, 2A, 2B:
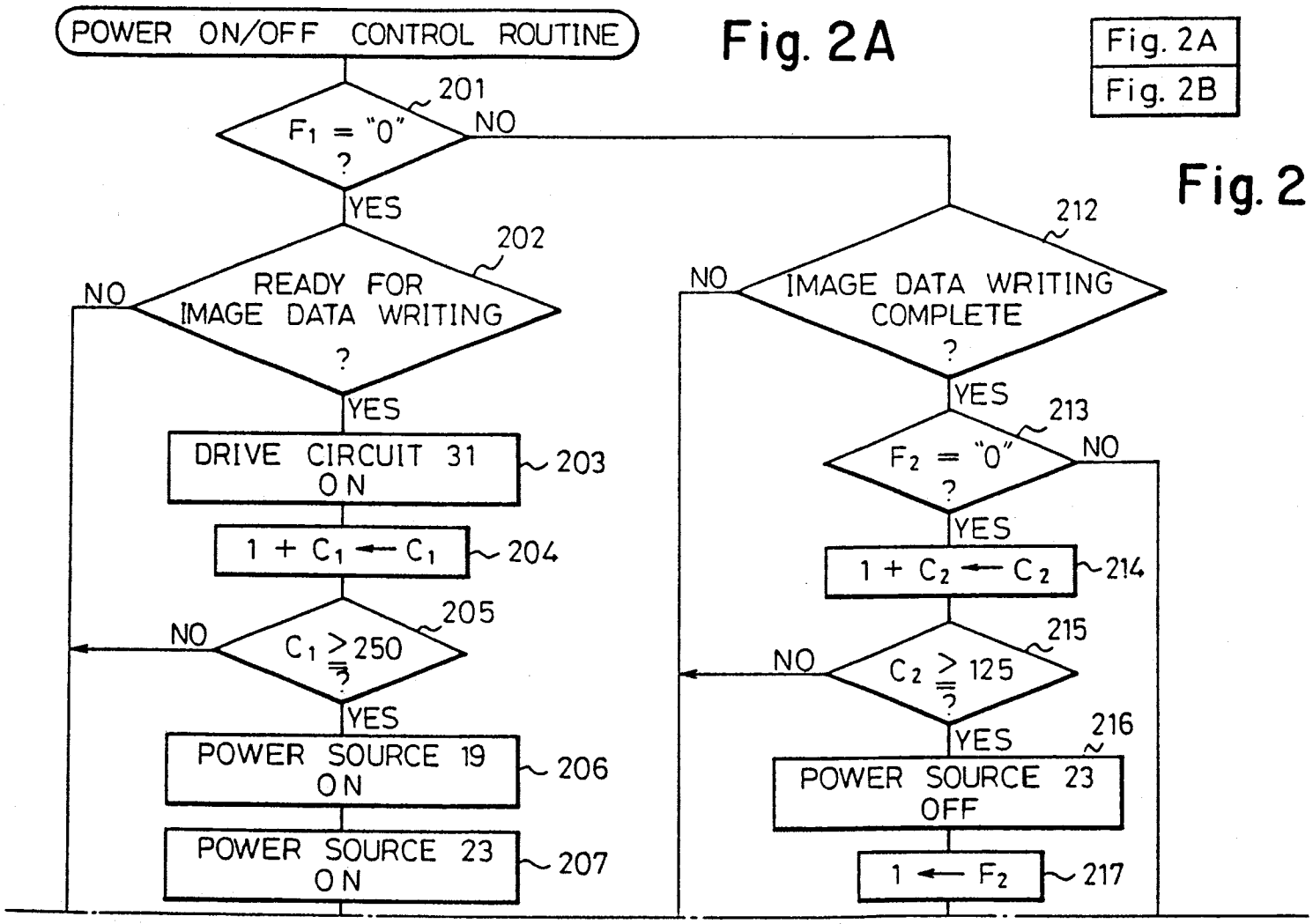
FIG. 2, composed of FIGS. 2A and 2B, is a flow chart for explaining an operation of the developing device of FIG. 1.
Figure 2B:
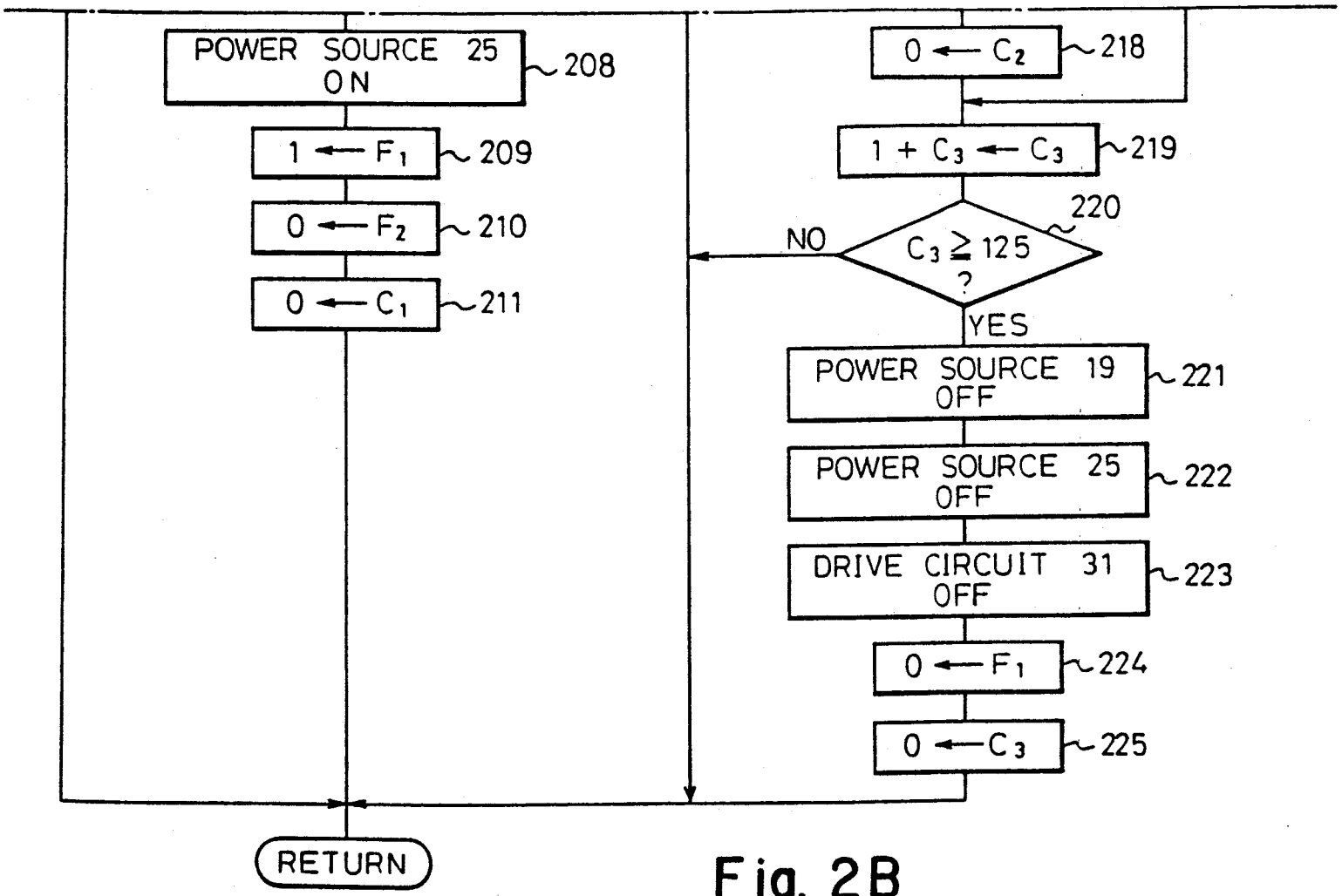

The operation of the developing device 10 will be now explained with reference to FIGS. 2 and 3. The operation may be carried out, for example, under the following conditions:

(1) The photosensitive film 14*b* of the photosensitive drum 14 is formed of an organic photoconductive (OPC), and a distribution of a negative charge is produced thereon, a charged area of which may have a potential of about −650 volts. In this case, the latent image zone formed on the drum 14 by the optical writing means may have a potential of about −50 volts. On the other hand, the toner particles are given a negative charge.

(2) The developing roller 18 is rotated at a peripheral speed of 175 mm/s, and a developing bias voltage of −300 volts is supplied by the DC power source 19 to the developing roller 18.

(3) A voltage of −400 volts is supplied by the DC power source 23 to the blade member 20.

(4) A voltage of −250 volts is supplied by the DC power source 25 to the toner-removing roller 24.

Figure 3:
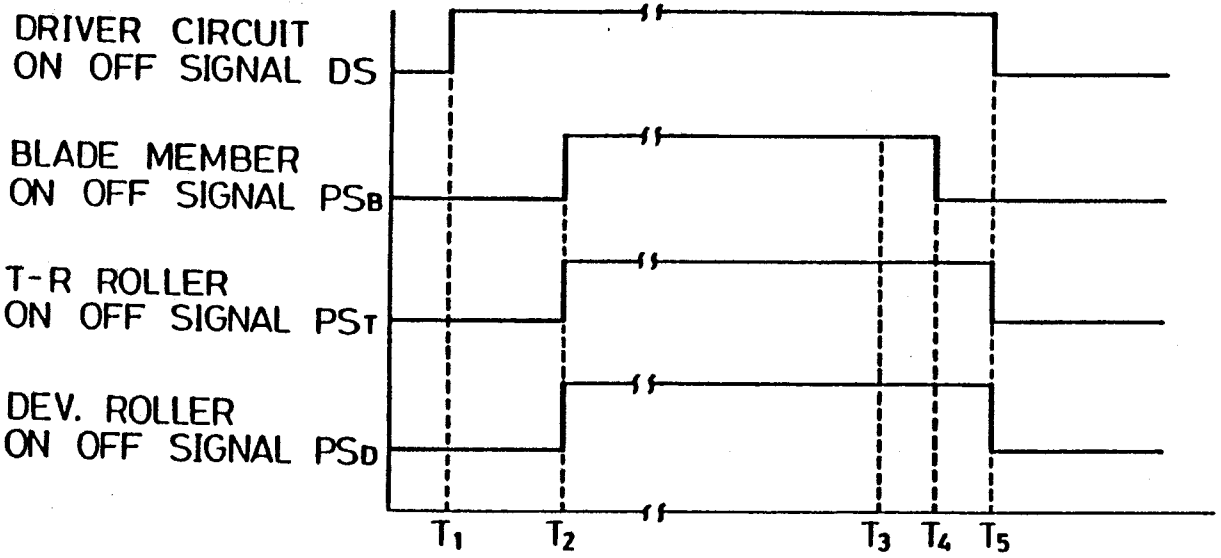
FIG. 3 is a time chart in relation to the flow chart of FIG. 2.
Figure 4:
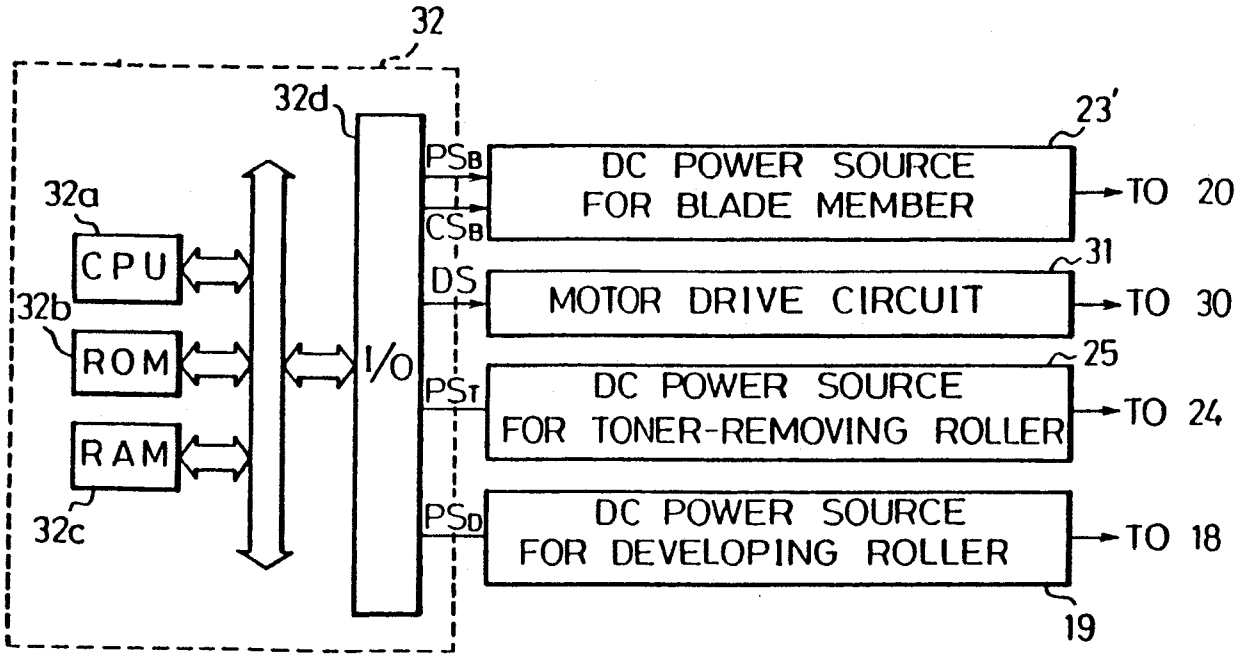
FIG. 4 is a partial schematic diagram of a modification of the embodiment shown in FIG. 1.

FIG. 3 shows a power ON/OFF control routine for the DC power sources 19, 23, and 15 and the motor drive circuit 31, which routine is executed by interruptions output at intervals of 4 ms. FIG. 4 shows a time charge with relation to the routine of FIG. 2.

At step 201, it is determined whether a flag $F_1$ is "0" or "1". Since the $F_1$ is initially made "0", the control proceeds to step 202 and it is determined whether or not the printer is ready for writing image data (latent image) on the photosensitive drum 14 by the optical writing means (not shown). If the printer is not ready for the image data writing, the routine is once completed. Although the routine is repeatedly executed at intervals of 4 ms, the control does not proceed from step 202 to step 203 until the printer is ready for the image data writing.

For example, when the printer is ready for the image data writing at a time of $T_1$ (FIG. 3), the control proceeds to step 203, in which an ON/OFF signal DS input from the countrol circuit 32 to the motor drive circuit 31 rises, as shown in FIG. 3, so that the drive motor 30 is driven to rotate the developing roller 18, the toner-removing roller 24, the paddle roller 26, and the agitator 28. Then, at step 204, a counter $C_1$ is incremented by 1, and at step 205, it is determined whether or not the counter number of the counter $C_1$ is larger than 250. If $C_1<250$, the routine is once completed. Although the routine is repeatedly executed at intervals of 4 ms, the counter $C_1$ is only incremented by 1 until the count number thereof reaches 250.

At step 205, when the count number of the counter $C_1$ reaches 250, i.e., 1 second has elapsed, the control successively proceeds to steps 206, 207, and 208, in which power ON/OFF signals $PS_D$, $PS_B$, and $PS_T$ input from the control circuit 32 to the DC power sources 19, 23, and 25 rise at a time of $T_2$ ($T_1-T_2=1$ sec.), as shown in FIG. 3, so that the voltages of −300, −400, and −250 volts are supplied to the developing roller 18, the blade member 20, and the toner-removing roller 24, respectively. Then, at step 209, the flag $F_1$ is made "1"; at step 210, a flag $F_2$ is made "0"; and a step 211, the counter $C_1$ is reset.

Thereafter, even if the routine is repeatedly executed at intervals of 4 ms, the control is only returned through steps 201 and 212 ($F_1=1$) until the image data writing is completed. During this period, the developing device 10 carries out a developing process wherein the written image data (latent image) is developed. In particular, the toner particles are entrained by the developing roller 18 to form a developer layer therearound, and a thickness of the developer layer is uniformly regulated by the blade member 20 while the toner particles of the developer layer are electrically charged by the charge-injection effect resulting from the supply of the voltage of −400 volts to the blade member 20. Note, an electrostatic adhesion of the negative toner particles to the blade member is prevented because the blade member has a lower potential (−400 volts) than that (−300 volts) of the developing roller 18. Then, when the developer layer having the regulated thickness is carried to the surface of the photosensitive drum 14, the toner particles are electrostatically attracted only to the latent image zone having the potential of about −50 volts, due to the supply of the developing bias voltage of −300 volts to the developing roller 18, as if the latent image zone were charged with the negative toner particles, and thus the toner development of the latent image is carried out. The remaining toner particles not used for the development are mechanically removed from the developing roller 18 by the toner-removing roller 24, but the remaining toner particles also can be electrostatically removed from the developing roller 18 by the supply of a voltage of −250 volts to the toner-removing roller 24 having a higher potential than the developing bias voltage −300 volts of the developing roller 18.

When the routine is executed after the image data writing is completed at, for example, a time of $T_3$, as shown in FIG. 3, the control proceeds from step 212 to step 213, in which it is determined whether the flag $F_2$ is "0" or "1". Since the flag $F_2=0$, the control proceeds to step 214 in which a counter $C_2$ is incremented by 1, and a step 215, it is determined whether or not the count number of the counter $C_2$ is larger than 125. If $C_2<125$, the routine is once completed. Although the routine is repeatedly executed at intervals of 4 ms, the counter $C_2$ is only incremented by 1 until the counter number thereof reaches 125.

At step 215, when the counter number of the counter $C_2$ reaches 125, i.e., 0.5 second has elapsed, the control proceeds to step 216, at which the power ON/OFF signal $PS_B$ falls at a time of $T_4$ ($T_3-T_4=0.5$ sec.), as shown in FIG. 3, so that the power source 23 for the blade member 20 is made OFF. During this time of 0.5 second, the last written image data (latent image) is developed. Then, at a step 217, the flag $F_2$ is made "0", and a step 218, the counter $C_2$ is reset.

Subsequently, the control proceeds to step 219 in which a counter $C_3$ is incremented by 1, and a step 220, it is determined whether or not the count number of the counter $C_3$ is larger than 125. If $C_3<125$, the routine is once completed. Although the routine is repeatedly executed at intervals of 4 ms, the counter $C_3$ is only incremented by 1 until the count number thereof reaches 125 (Note, $F_2=1$).

At step 220, when the counter number of the counter $C_3$ reaches 125, i.e., 0.5 second has elapsed, the control successively proceeds to steps 221, 222, and 223, at which the power ON/OFF signals $PS_D$, and $PS_T$ and the drive circuit ON/OFF signals DS fall at a time of $T_5$ ($T_4-T_5=0.5$ sec.), as shown in FIG. 3, so that the power sources 19 and 25 and the motor drive circuit 31 are made OFF. Then, at step 224, the flag $F_1$ is made "0", and at step 225, the counter $C_3$ is reset.

As apparent from the above description, since the supply of the voltages to the developing roller 18, the blade member 20, and the toner-removing roller 24 is carried out after the time of 1 second has elapsed (i.e., after the rotation of the developing roller 18 is started), a high electrical current flow cannot occur at localized contacting zones between the developing roller 18 and the blade member 20 and toner-removing roller 24. Also, when a developing operation of the developing device 10 is interrupted or stopped, the DC power source 23 for the blade member 20 is prematurely made OFF. so that the toner particles entrained by the developing roller 18 are electrostatically removed therefrom by the blade member 20; because the negative toner particles are electrostatically attracted to the blade member 20 having the potential (0 volts) higher than that (−300 volts) of the developing roller 18. As a result, during the non-operative condition of the developing device 10, the toner particles can be eliminated from the contacting area between the photosensitive drum 14 and the developing roller 18.

FIG. 4 shows a modification of the embodiment shown in FIG. 1, in which a DC power source 23' for the blade member 20 is constituted such that an output thereof can be changed from one of two levels of −400 and +200 volts to the other level.

Figure 5:
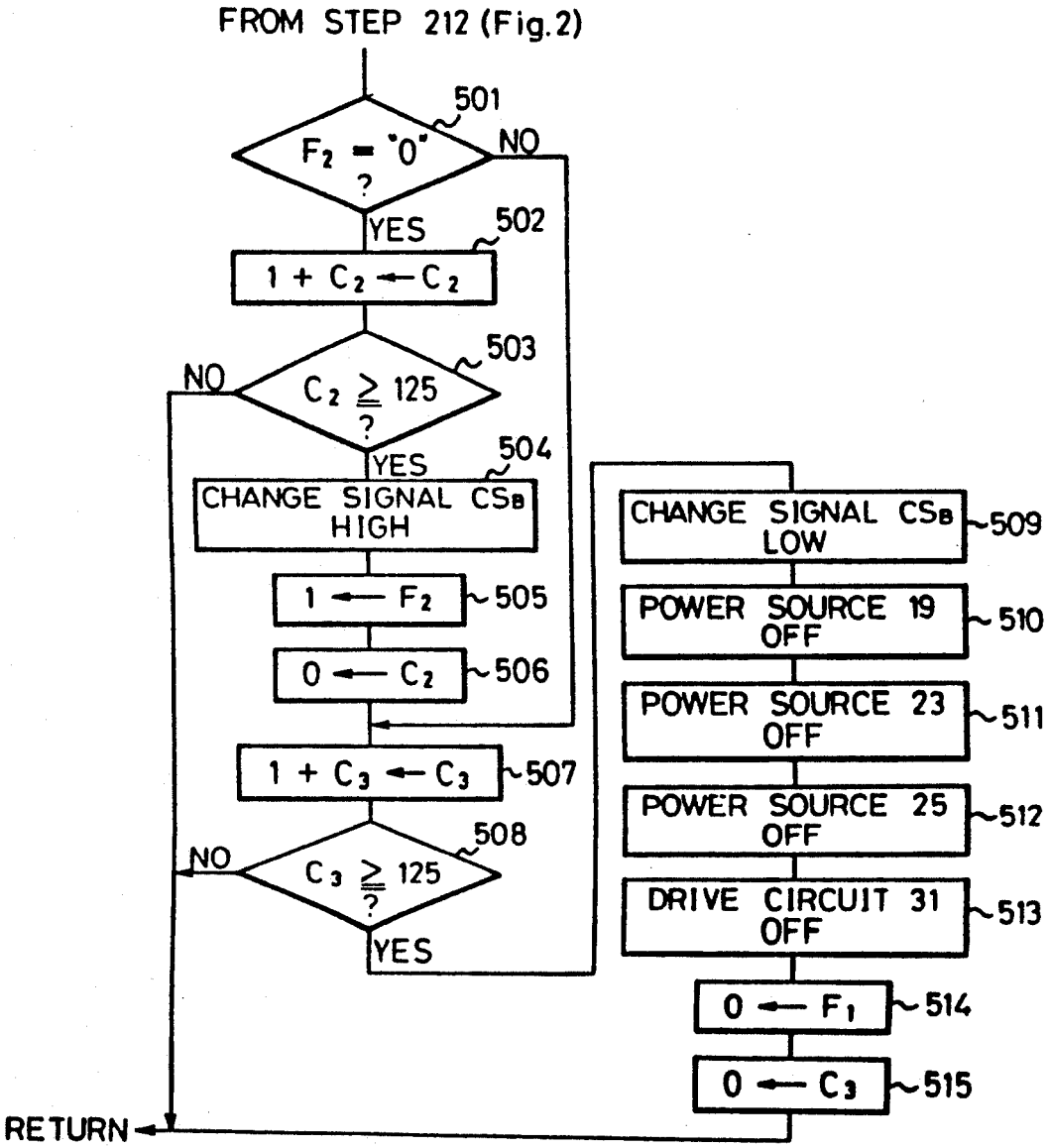
FIG. 5 is a partial flow chart for explaining an operation of the modified embodiment of FIG. 4.
Figure 6:
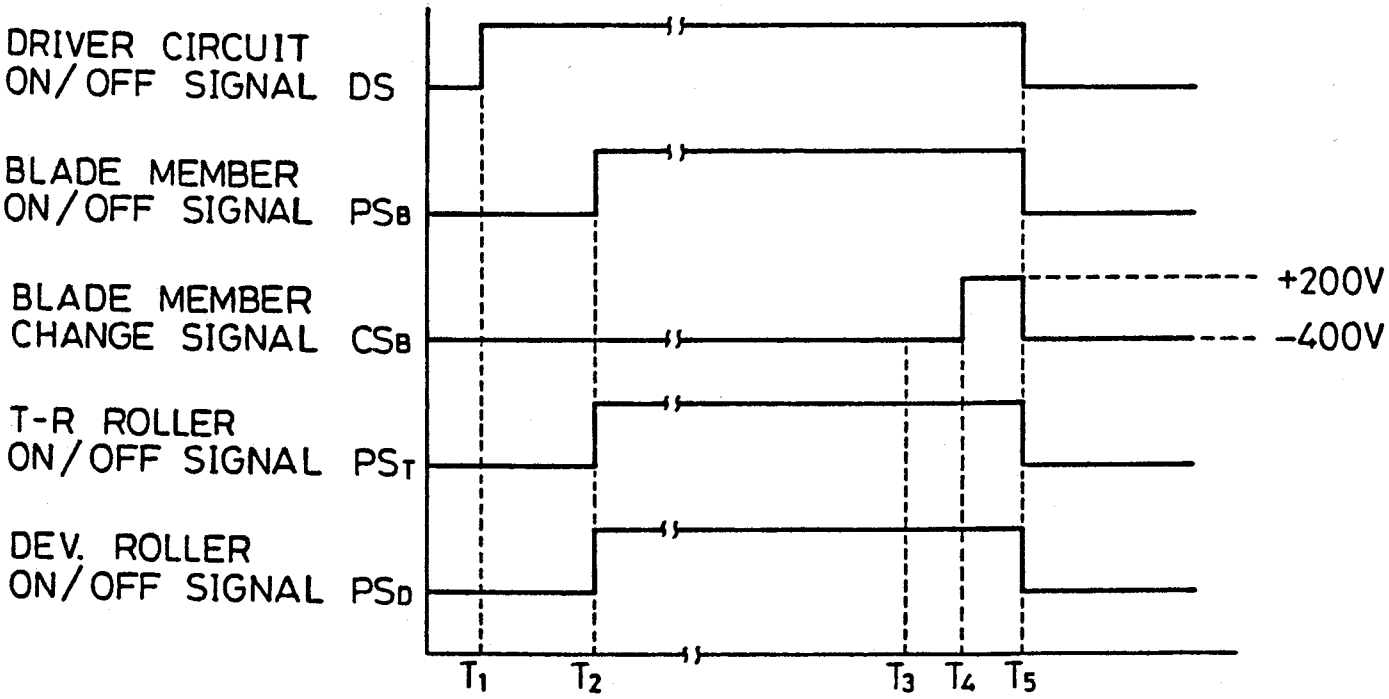
FIG. 6 is a time chart in relation to the flow chart of FIG. 5.

The operation of the modified embodiment of FIG. 4 will be now explained with reference to FIGS. 5 and 6. Note, the routine of FIG. 5 is partially shown, but the whole thereof can be seen with reference to FIG. 2. FIG. 6 is a time chart with relation to the routine of FIG. 5.

As explained with reference to FIG. 2, in this operation, an ON/OFF signal DS input from the control circuit 32 to the motor drive circuit 31 also rises at a time of $T_1$ (FIG. 6) when the printer is ready for the image data writing, so that the drive motor 30 is driven to rotate the developing roller 18, the toner-removing roller 24, the paddle roller 26, and the agitator 28, and then power ON/OFF signals $PS_D$, $PS_B$, and $PS_T$ input from the control circuit 32 to the DC power sources 19, 23, and 25 rise at a time of $T_2$ ($T_1-T_2=1$ sec.), as shown in FIG. 6, so that the voltages of −300, −400, and −250 volts are supplied to the developing roller 18, the blade member 20, and the toner-removing roller 24, respectively.

When the routine is executed after the image data writing is completed at a time of $T_3$, as shown in FIG. 6, the control proceeds from step 212 to step 501, in which it is determined whether the flag $F_2$ is "0" or "1". Since the flag $F_2=0$, the control proceeds to step 502 in which a counter $C_2$ is incremented by 1, and at step 503, it is determined whether or not the count number of the counter $C_2$ is larger than 125. If $C_2<125$, the routine is once completed. Although the routine is repeatedly executed at intervals of 4 ms, the counter $C_2$ is only incremented by 1 until the count number thereof reaches 125.

At step 503, when the count number of the counter $C_2$ reaches 125, i.e., 0.5 second has elapsed, the control proceeds to step 504, at which a change signal CS output from the control circuit 32 to the DC power source 23' rises at a time $T_4$ ($T_3-T_4=0.5$ sec.), as shown in FIG. 6, so that the output level of the DC power source 23' is changed from −400 volts to +200 volts. During this time of 0.5 second, the last written image data (latent image) is developed. Then, at step 504, the flag $F_2$ is made "1", and at step 506, the counter $C_2$ is reset.

Subsequently, the control proceeds to the step 507 in which a counter $C_3$ is incremented by 1, and at step 508, it is determined whether or not the count number of the counter $C_3$ is larger than 125. If $C_3<125$, the routine is once completed. Although the routine is repeatedly executed at intervals of 4 ms, the counter $C_3$ is only incremented by 1 until the counter number thereof reaches 125 (Note, $F_2=1$).

At step 508, when the count number of the counter $C_3$ reaches 125, i.e., 0.5 second has elapsed, the control successively proceeds to steps 509, 510, 511, 512, and 513, at which the change signal CS, the power ON/OFF signals $PS_D$, $PS_B$ and $PS_T$, and the drive circuit ON/OFF signal DS fall at a time of $T_5$ ($T_4-T_5=0.5$ sec.), as shown in FIG. 6, so that the power sources 19, 23 and 25, and the motor drive circuit 31 are made OFF. Then, at step 514, the flag $F_1$ is made "0", and at step 515, the counter $C_3$ is reset.

In the modified embodiment of FIG, 4, when a developing operation of the developing device 10 is stopped, the positive voltage of +200 volts is supplied to the blade member 20 so that the negative toner particles can be removed from the developing roller 18 with a larger electrostatic attraction.

When the photosensitive drum is formed of a selenium photoconductor or an amorphous silicone photoconductor, on which a distribution of positive charges is produced, the toner particles are positively charged and positive voltages are supplied to the developing roller, the blade member, and the toner-removing roller.

Although the embodiments of the present invention are explained in relation to a photosensitive drum, they can be also applied to a dielectric drum on which the electrostatic latent image can be formed. Further, although the developing device according to the present invention is used for the non-magnetic type one-component developer, the magnetic type one-component developer may be also used, if necessary.

Also, in the embodiments as mentioned above, although the developing device is provided with the toner-removing roller, it may be omitted therefrom, if necessary.

Finally, it will be understood by those skilled in the art that the foregoing description is of preferred embodiments of the present invention, and that various changes and modifications can be made thereto without departing from the spirit and scope thereof.

We claim:

1. A developing device using a one-component developer composed of toner particles, which device comprises:

a vessel for holding the developer;

a developing roller rotatably provided within and supported by said vessel in such a manner that a portion of said developing roller is exposed therefrom, the exposed portion of said developing roller being pressed against a surface of an electrostatic latent image carrying body, said developing roller being formed of a conductive elastic material by which the toner particles are entrained to form a developer layer therearound and are carried to the surface of said electrostatic latent image carrying body for development of an electrostatic latent image formed thereon;

a drive motor for rotating said developing roller;

a motor drive circuit for driving said drive motor;

a first power source for supplying a developing bias voltage to said developing roller;

a blade member provided within said vessel, said blade member being pressed against said developing roller for regulating a thickness of the developer layer formed therearound;

a second power source for supplying a voltage to said blade member to inject an electric charge to the toner particles of said developer layer and/or to prevent an electrostatic adhesion of the toner particles to said blade member; and means for controlling a timing of outputs of said first and second power sources and said motor drive circuit in such a manner that the supply of the voltages to said developing roller and blade member is carried out after said developing roller is rotated by said drive motor,

2. A developing device as set forth in claim 1, wherein said developing roller is formed of a conductive open-cell foam material so that pore openings are formed over a surface of said developing roller, said pore openings having a diameter which is at most twice an average diameter of the toner particles.

3. A developing device as set forth in claim 2, wherein the conductive open-cell foam material of said developing roller is selected from the group consisting of a conductive polyurethane open-cell foam rubber material, a conductive silicone foam rubber material, and a conductive acrylonitorile-butadiene open-cell foam rubber material.

4. A developing device as set forth in claim 1, further comprising:

a toner-removing roller rotatably provided within and supported by said vessel in such a manner that said toner-removing roller is resiliently pressed against said developing roller, said toner-removing roller being formed of a conductive elastic material and being rotated so that remaining toner particles not used in the development of a latent image are mechanically removed from said developing roller;

a third power source for supplying a voltage to said toner-removing roller, to thereby electrostatically remove remaining toner particles from said developing roller; and said control means also controlling a timing of an output of said third power source in such a manner that a supply of the voltage to said toner-removing roller is carried out after said developing roller is rotated by said drive motor.

5. A developing device as set forth in claim 1, further comprising means for controlling said first and second power sources and said motor drive circuit in such a manner that a supply of the voltage to said blade member is prematurely stopped before the supply of voltage to said developing roller is stopped and the rotation of said developing roller is stopped.

6. A developing device using a one-component developer composed of toner particles, which device comprises:

a vessel for holding the developer;

a developing roller rotatably provided within and supported by said vessel in such a manner that a portion of said developing roller is exposed therefrom, the exposed portion of said developing roller being pressed against a surface of an electrostatic latent image carrying body, said developing roller being formed of a conductive elastic material by which the toner particles are entrained to form a developer layer therearound and are carried to the surface of said electrostatic latent image carrying body for development of an electrostatic latent image formed thereon;

a drive motor for rotating said developing roller;

a motor drive circuit for driving said drive motor;

a first power source for supplying a developing bias voltage to said developing roller;

a blade member provided within by said vessel, said blade member being pressed against said developing roller for regulating a thickness of the developer layer formed therearound;

a second power source for supplying a voltage to said blade member to inject an electric charge to the toner particles of said developer layer and/or to prevent an electrostatic adhesion of the toner particles to said blade member;

a toner-removing roller rotatably provided within and supported by said vessel in such a manner that it is resiliently pressed against said developing roller, said toner-removing roller being formed of a conductive elastic material and being rotated so that remaining toner particles not used for the development of the latent image are mechanically removed from said developing roller;

a third power source for supplying a voltage to said toner-removing roller to electrostatically remove the remaining toner particles from said developing roller; and means for controlling a timing of outputs of said first, second, and third power sources and said motor drive circuit in such a manner that the supply of the voltages to said developing roller, blade member, and toner-removing roller is carried out after said developing roller is rotated by said drive motor.

7. A developing device as set forth in claim 6, wherein said developing roller is formed of a conductive open-cell foam material so that pore openings are formed over a surface of said developing roller, said pre openings having a diameter which is at most twice an average diameter of the toner particles.

8. A developing device as set forth in claim 7, wherein the conductive open-cell foam material of said developing roller is selected from the group consisting of a conductive polyurethane open-cell foam rubber material, a conductive silicone foam rubber material, and a conductive acrylonitorile-butadiene open-cell foam rubber material.

9. A developing device as set forth in claim 6, wherein said toner-removing roller is formed of a conductive open-cell foam rubber material.

10. A developing device as set forth in claim 6, further comprising means for controlling said first, second and third power sources and said motor drive circuit in such a manner that the supply of the voltage to said blade member is prematurely stopped before the supply of the voltage to said developing roller and toner-removing roller is stopped and the rotation of said developing roller is stopped.

11. A developing device using a one-component developer composed of toner particles, which device comprises:

a vessel for holding the developer;

a developing roller rotatably provided within and supported by said vessel in such a manner that a portion of said developing roller is exposed therefrom, the exposed portion of said developing roller being pressed against a surface of an electrostatic latent image carrying body, said developing roller being formed of a conductive elastic material by which the toner particles are entrained to form a developer layer therearound and are carried to the surface of said electrostatic latent image carrying body for development of an electrostatic latent image formed thereon;

a drive motor for rotating said developing roller;

a motor drive circuit for driving said drive motor;

a first power source for supplying a developing bias voltage to said developing roller;

a blade member provided within by said vessel, said blade member being pressed against said developing roller for regulating a thickness of the developer layer formed therearound;

a second power source for supplying a voltage to said blade member to inject an electric charge in said developer layer and/or to prevent an electrostatic adhesion of the toner particles to said blade member; and means for controlling said first and second power sources and said motor drive circuit in such a manner that the supply of the voltage to said blade member is prematurely stopped before the supply of the voltage to said developing roller and the rotation of said developing roller are stopped.

12. A developing device as set forth in claim 11, wherein said developing roller is formed of a conductive open-cell foam material so that pore openings are formed over a surface of said developing roller, said pore openings having a diameter which is at most twice an average diameter of the toner particles.

13. A developing device as set forth in claim 12, wherein the developing roller is cylindrical.

14. A developing device as set forth in claim 11, further comprising second means for controlling a timing of outputs of said first and second power sources and said motor drive circuit in such a manner that the supply of voltage to said developing roller and said blade member is carried out after said developing roller is rotated by said drive motor.

15. A developing device as set forth in claim 14, further comprising:

a toner-removing roller rotatably provided within and supported by said vessel in such a manner that said toner-removing roller is resiliently pressed against said developing roller, said toner-removing roller being formed of a conductive elastic material and being rotated so that remaining toner particles not used in the development of a latent image are mechanically removed from said developing roller;

a third power source for supplying a voltage to said toner-removing roller, to thereby electrostatically remove remaining toner particles from said developing roller; and said second control means also controlling a timing of an output of said third power source in such a manner that a supply of the voltage to said toner-removing roller is carried out after said developing roller is rotated by said drive motor.

16. A developing device using a one-component developer composed of toner particles, which device comprising:

a vessel for holding the developer;

a developing roller rotatably provided within and supported by said vessel in such a manner that a portion of said developing roller is exposed therefrom, the exposed portion of said developing roller being pressed against a surface of an electrostatic latent image carrying body, and said developing roller being formed of a conductive elastic material by which the toner particles are entrained to form a developer layer therearound and are carried to the surface of said electrostatic latent image carrying body for development of an electrostatic latent image formed thereon;

a drive motor for rotating said developing roller;

a motor drive circuit for driving said drive motor;

a first power source for supplying a developing bias voltage to said developing roller;

a blade member provided within by said vessel, said blade member being pressed against said developing roller for regulating a thickness of the developer layer formed therearound;

a second power source for selectively supplying one of first and second voltages to said blade member, said first voltage having a polarity opposite to that of the second voltage, said first voltage being supplied to said blade member to inject an electric charge to the toner particles of said developer layer and/or to prevent an electrostatic adhesion of the toner particles to said blade member during and development of the latent image, said second voltage being supplied to said blade member to electrostatically remove the toner particles of said developer layer from said developing roller after the development of the latent image is completed; and means for controlling said first and second power sources and said motor drive circuit in such a manner that a change of the supply of said first voltage to the supply of said second voltage is carried out before the supply of the voltage to said developing roller and the rotation of said developing roller are stopped.

17. A developing device as set forth in claim 16, wherein said developing roller is formed of a conductive open-cell foam material so that pore openings are formed over a surface of said developing roller, said pore openings having a diameter which is at most twice an average diameter of the toner particles.

18. A developing device as set forth in claim 17, wherein the conductive open-cell foam material of said developing roller is selected from the group consisting of a conductive polyurethane open-cell foam rubber material, a conductive silicone foam rubber material, and a conductive acrylonitorile-butadiene open-cell foam rubber material.

19. A developing device using a one-component developer composed of toner particles, which device comprises:

a vessel for holding the developer;

a developing roller rotatably provided within and supported by said vessel in such a manner that a portion of said developing roller is exposed therefrom, the exposed portion of said developing roller being pressed against a surface of an electrostatic latent image carrying body, said developing roller being formed of a conductive elastic material by which the toner particles are entrained to form a developer layer therearound and are carried to the surface of said electrostatic latent image carrying body for development of an electrostatic latent image formed thereon;

a drive motor for rotating said developing roller;

a motor drive circuit for driving said drive motor;

a first power source for supplying a developing bias voltage to said developing roller;

a blade member provided within by said vessel, said blade member being pressed against said developing roller for regulating a thickness of the developer layer formed therearound;

a second power source for supplying a voltage to said blade member to inject an electric charge to the toner particles of said developer layer and/or to prevent an electrostatic adhesion of the toner particles to said blade member;

a toner-removing roller rotatably provided within and supported by said vessel in such a manner that it is resiliently pressed against said developing roller, said toner-removing roller being formed of a conductive, elastic material and being rotated so that remaining toner particles not used for the development of the latent image are mechanically removed from said developing roller;

a third power source for supplying a voltage to said toner-removing roller to electrostatically remove the remaining toner particles from said developing roller; and means for controlling said first, second, and third power sources and said motor drive circuit in such a manner that the supply of the voltage to said blade member is prematurely stopped before the supply of the voltages to said developing roller and toner-removing roller and the rotation of said developing roller are stopped.

20. A developing device as set forth in claim 19, wherein said developing roller is formed of a conductive open-cell foam material so that pore openings are formed over a surface of said developing roller, said pore openings having a diameter which is at most twice an average diameter of the toner particles.

21. A developing device as set forth in claim 20, wherein the conductive open-cell foam material of said developing roller is selected from the group consisting of a conductive polyurethane open-cell foam rubber material, conductive silicone foam rubber material, and a conductive acrylonitorile-butadiene open-cell foam rubber material.

22. A developing device as set forth in claim 19, wherein said toner-removing roller is formed of a conductive open-cell foam rubber material.

23. A developing device using a one-component developer composed of toner particles, which device comprises:

a vessel for holding the developer;

a developing roller rotatably provided within and supported by said vessel in such a manner that a portion of said developing roller is exposed therefrom, the exposed portion of said developing roller being pressed against a surface of an electrostatic latent image carrying body, said developing roller being formed of a conductive elastic material by which the toner particles are entrained to form a developer layer therearound and are carried to the surface of said electrostatic latent image carrying body for development of an electrostatic latent image formed thereon;

a drive motor for rotating said developing roller;

a motor drive circuit for driving said drive motor;

a first power source for supplying a developing bias voltage to said developing roller;

a blade member provided within by said vessel, said blade member being pressed against said developing roller for regulating a thickness of the developer layer formed therearound;

a second power source for selectively supplying one of first and second voltages to said blade member, said first voltage having a polarity opposite to that of the second voltage, said first voltage being supplied to said blade member to inject an electric charge to the toner particles of said developer layer and/or to prevent an electrostatic adhesion of the toner particles to said blade member during the development of the latent image, said second voltage being supplied to said blade member to electrostatically remove the toner particles of said developer layer from said developing roller after the development of the latent image is completed;

a toner-removing roller rotatably provided within and supported by said vessel in such a manner that it is resiliently pressed against said developing roller, said toner-removing roller being formed of a conductive elastic material and being rotated so that remaining toner particles not used for the development of the latent image are mechanically removed from said developing roller;

a third power source for supplying a voltage to said toner-removing roller to electrostatically remove the remaining toner particles from said developing roller; and means for controlling said first, second, and third power sources and said motor drive circuit in such a manner that a change of the supply of said first voltage to the supply of said second voltage is carried out before the supply of the voltages to said developing roller and toner-removing roller and the rotation of said developing roller are stopped.

24. A developing device as set forth in claim 23, wherein said developing roller is formed of a conductive open-cell foam material so that pore openings are formed over a surface of said developing roller, said pore openings having a diameter which is at most twice an average diameter of the toner particles.

25. A developing device as set forth in claim 24, wherein the conductive open-cell foam material of said developing roller is selected from the group consisting of a conductive polyurethane open-cell foam rubber material, a conductive silicone foam rubber material, and a conductive acrylonitorile-butadiene open-cell foam rubber material.

26. A developing device as set forth in claim 23, wherein said toner-removing roller is formed of a conductive open-cell foam rubber material.

* * * * *